US010406570B1

(12) United States Patent
Oakner et al.

(10) Patent No.: US 10,406,570 B1
(45) Date of Patent: Sep. 10, 2019

(54) INLINE DRAIN LINE ACCESS DEVICE WITH CLEANOUT ADAPTER

(71) Applicant: MSD Research, Inc., Boca Raton, FL (US)

(72) Inventors: Stuart Oakner, Boca Raton, FL (US); Donna Oakner, Boca Raton, FL (US)

(73) Assignee: RS ACQUISITION SUB, LLC, Houston, TX (US)

( * ) Notice: Subject to any disclaimer, the term of this patent is extended or adjusted under 35 U.S.C. 154(b) by 0 days.

(21) Appl. No.: 15/970,233

(22) Filed: May 3, 2018

(51) Int. Cl.

| | |
|---|---|
| ***B08B 9/027*** | (2006.01) |
| ***B08B 9/035*** | (2006.01) |
| ***F25D 21/14*** | (2006.01) |
| ***F24F 11/30*** | (2018.01) |
| ***B08B 9/032*** | (2006.01) |
| *F24F 140/30* | (2018.01) |
| *F24F 13/22* | (2006.01) |

(52) U.S. Cl.
CPC ..... *B08B 9/035* (2013.01); *B08B 9/027* (2013.01); *B08B 9/0321* (2013.01); *F24F 11/30* (2018.01); *F25D 21/14* (2013.01); *F24F 2013/227* (2013.01); *F24F 2140/30* (2018.01); *F25B 2500/04* (2013.01)

(58) Field of Classification Search
CPC ..... B08B 9/035; B08B 9/027; B08B 9/032; B08B 9/0321; B08B 9/02; B08B 9/021; B08B 9/04; B08B 9/043; F25D 21/14; F24F 11/30
USPC ..... 137/240, 238
See application file for complete search history.

(56) References Cited

U.S. PATENT DOCUMENTS

| | | | | |
|---|---|---|---|---|
| 1,274,103 | A * | 7/1918 | Story | F16K 1/446 123/198 R |
| 1,655,796 | A * | 1/1928 | Murphy | F16L 15/02 134/166 R |
| 5,421,904 | A * | 6/1995 | Carlson | B08B 9/0321 134/167 C |
| 6,761,184 | B1 * | 7/2004 | Jordan | B08B 9/0321 134/166 C |
| 8,967,183 | B2 * | 3/2015 | Oakner et al. | F24F 13/222 134/102.2 |
| 9,217,580 | B2 * | 12/2015 | Oakner et al. | F24F 13/222 |
| 2014/0338758 | A1 * | 11/2014 | Oakner et al. | B08B 9/027 137/240 |
| 2018/0243805 | A1 * | 8/2018 | Davis | B08B 9/035 |

* cited by examiner

*Primary Examiner* — Kevin L Lee
(74) *Attorney, Agent, or Firm* — Robert M. Downey, P.A.

(57) ABSTRACT

An access device for installation to a condensation drainage system, such as a drain line of an HVAC unit, includes a main body with connecting ports at opposite ends for sealed, fluid flow inline connection to the drainage system. A top cover releasably secures to the main body to completely cover and seal an open top and interior cavity. A cleanout adapter has a flange that surrounds a bottom opening. The flange includes a seal around its outer periphery and is structured for sliding receipt within either of two transverse slots within the interior cavity to position the bottom opening of the adapter in sealed alignment with either of the connection ports, whereby a pressurized gas or liquid flow source, or a vacuum source can be connected to a top opening of the adapter for clearing a clog in the drain line either upstream or downstream of the access device.

7 Claims, 5 Drawing Sheets

INLINE DRAIN LINE ACCESS DEVICE WITH CLEANOUT ADAPTER

BACKGROUND OF THE INVENTION

Field of the Invention

This invention relates to an access device for inline installation to drain lines and other fluid transfer conduits and, more particularly, to a compact inline access device that includes a cleanout adapter that slides into and seals within the access device for connecting a pressurized liquid or gas source or vacuum source to clear clogs in air conditioning and refrigeration condensate drain lines and other fluid transfer lines.

Discussion of the Related Art

In various systems and equipment, there is a need to transfer and/or drain liquid from the equipment to a separate location. For example, in air conditioning and refrigeration systems, condensation naturally occurs as warm, humid air passes over the exterior of the evaporator coil in the HVACR unit. Typically, the condensation drips from the evaporator coil into a condensate collection pan positioned below the evaporator coil. From the collection pan, the liquid condensate is directed through a drain line that leads to an appropriate discharge location, such as the exterior of a building. It is not uncommon for these and other types of drain lines to occasionally become partially or completely clogged, resulting in a backup of condensate liquid in the drain line and the collection pan of the HVACR unit. In particular, the slow and continuous movement of condensate liquid through the drain line (i.e., by gravity transfer) encourages the growth and accumulation of algae, bacteria, dust, corrosive residue and other debris that builds up in the drain line and eventually causes a partial or complete blockage. The backup of condensate in the drain line and collection pan can result in an accidental overflow of condensate during the continuous operation of the HVACR equipment, possibly resulting in extensive and costly damage to the building structure and contents. This is a common problem that is well known in the industry.

In order to avoid clogs and accidental condensate overflows in HVACR condensate drain lines, it is recommended that the drain lines be cleaned (i.e., cleared of debris and residue) at least twice a year during normal maintenance procedures. Typically, cleaning of drain lines is achieved by introducing a pressurized flow of liquid or gas through one end of the drain line which serves to push debris, residue and blockages through the drain line and out through the opposite end. In most instances, when using a pressurized flow through the drain line for cleaning, it is desirous to gain access to the upper end of the condensate drain line near the air conditioner or refrigeration unit so that the pressure may be applied at the upper end, while pushing the clogging materials out through the opposite end, usually at an exterior of the building. Access to the upper end of the drain line requires detaching the drain line from the air conditioning or refrigeration unit and then replacing the drain line wherein the maintenance is completed. In many instances, access to the drain line can only be achieved by cutting the drain line near the HVACR unit to create an open end for injection of a pressurized gas or fluid. After cleaning, the cut drain line must then be repaired by inserting a connecting joint. This repair process compromises the water tight integrity of the drain line, and can often result in leaks at the repair joint.

In order to overcome the above-described problems associated with drain line clogs and maintenance for cleaning drain lines in HVACR systems, others have proposed for the installation of permanent inline assemblies that allow for access to the drain line to inject pressurized gas or liquid without the need of separating the drain line from the equipment or cutting the drain line. These various inline assemblies typically employ the use of a manually operated ball valve or gate valve that is closed during the clean out procedure so that the forced flow of gas or liquid is directed in one direction, usually away from the HVACR equipment. Use of a valve is advantageous in order to close off the drain line between the valve and a clog in the line. The pressurized flow of gas or liquid can then be introduced into the drain line between the closed valve and the clog, creating sufficient pressure to push the clog out through the line until the drain line is completely cleared of debris and clogging residue. However, after the cleanout procedure, the manually operated valve must be opened by the service person, otherwise the closed valve will act as a clog by preventing flow and draining of condensate liquid through the drain line to the desired discharge location.

The need to operate a manual shut-off valve in the various inline drain flushing systems of the related art presents several problems. In particular, the rotational force exerted on the manual valve control can cause bending or breaking of the drain line pipe and/or connecting joints, especially over time when the valve accumulates residue and tends to stick and resist movement. Eventually, the valve would need to be replaced which requires cutting the drain line at two locations. Another major concern with use of manually operated shut-off valves along an HVACR drain line is human error. If the service person forgets to re-open the valve after cleaning the drain line, the liquid condensate will not be permitted to drain out from the drain line and will, instead, back up into the HVACR unit drain pan, possibly resulting in an accidental overflow as the HVACR unit continues to operate.

Considering the foregoing problems and limitations associated with existing drain line clearance methods and devices, there exists a need for a compact and low profile drain line access device that is structured for inline installation to an existing drain line without obstructing the flow of drain line contents, and a cleanout adapter that slides into and seals within an interior cavity of the access device in fluid flow communication with the drain line (i.e., either upstream or downstream of the access device), and wherein the cleanout adapter is structured for connection to a pressurized gas or liquid source, or a vacuum source, to thereby allow convenient flushing of the drain line in both upstream and downstream directions, and further wherein the cleanout adapter lines up perfectly with the drain line every time it is inserted within the interior cavity of the access device and is secured in this operative position without the need for the user to hold the cleanout adapter when clearing the drain line.

Objects and Advantages of the Invention

Considering the forgoing, it is a primary object of the present invention to provide inline access to fluid transfer lines, such as drain lines in HVACR systems, for purposes of cleaning (e.g., flushing) the lines without disrupting the integrity of the lines and without the need to manually operate shut-off valves to perform the cleaning.

It is a further object of the present invention to provide a drain line access device that allows for easy connection of a compressed gas or liquid delivery source to clean the line and clear any clogs.

It is still a further object of the present invention to provide a drain line access device for cleaning fluid transfer lines and clearing clogs either upstream or downstream of the device.

It is still a further object of the present invention to provide an inline access device for attachment to a drain line of an HVAC unit and wherein the access device includes a cleanout adapter that slides in and out of the access device and properly aligns and seals with the outlet or inlet port of the access device and an attached drain line.

It is still a further object of the present invention to provide an inline access device for HVAC unit drain lines and a cleanout adapter that slides within a track formed on the inside of the access device and wherein the cleanout adapter properly seals and aligns with the outlet or inlet port of the access device and an attached drain line each time the cleanout adapter is inserted.

It is still a further object of the present invention to provide a drain line access device and cleanout adapter, as set forth above, and wherein the cleanout adapter properly seals and aligns with the inlet or outlet port of the access device and an attached drain line and stays in place without the need to hold the adapter when clearing the drain line with an attached pressurized gas or liquid source or vacuum source.

It is still a further object of the present invention to provide an inline access device and cleanout adapter, as set forth above, which is easy to use.

It is still a further object of the present invention to provide an inline access device and cleanout adapter, as set forth above, which provides for a reduced size to allow the access device to be installed in tight spaces with limited room, and wherein the cleanout adapter is able to easily slide in and out of the access device without any difficulty.

These and other advantages of some embodiments are more readily apparent with reference to the detailed description and accompanying drawings.

SUMMARY OF THE INVENTION

The present invention is directed to an access device for inline installation to a drain line in a fluid transfer system. In one preferred embodiment, the access device is connected to a drain line extending from an air handler unit of an HVAC system to allow easy and convenient access to the drain line in order to clear a clog/obstruction in the drain line or to add clog preventing agents on a periodic basis. The access device includes a main body having connection ports on opposite ends for inline installation to the drain line (between the condensation producing source and drain discharge). The device includes a hinged top cover and a cleanout adapter that is sized and configured for insertion into the interior cavity of the main body for sealed alignment with one of the input or outlet ports (upstream or downstream direction). The cleanout adapter includes a top opening, a bottom opening oriented approximately 90 degrees to the top opening, and a fluid flow passage between the top and bottom openings. A flange surrounding the bottom opening has a rubber seal about its periphery. The flange is structured for sliding receipt within either of two transverse slots at opposite ends of the interior cavity, adjacent the respective input and outlet ports. When fully inserted within either of the transverse slots, the rubber seal of the flange engages the inside surfaces of the interior cavity, within the slot, and the bottom opening aligns perfectly with the respective input or outlet port in sealed, fluid flow relation therewith. The adapter allows for connection of virtually any pressurized gas or liquid flow source, or a vacuum source, as well as pouring of a liquid (e.g. anti-clogging agent) either upstream or downstream in the drain line for flushing out and/or preventing a clog in the drain line.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the drain line access device of the present invention is shown and is generally indicated as 10.

Figure 1:
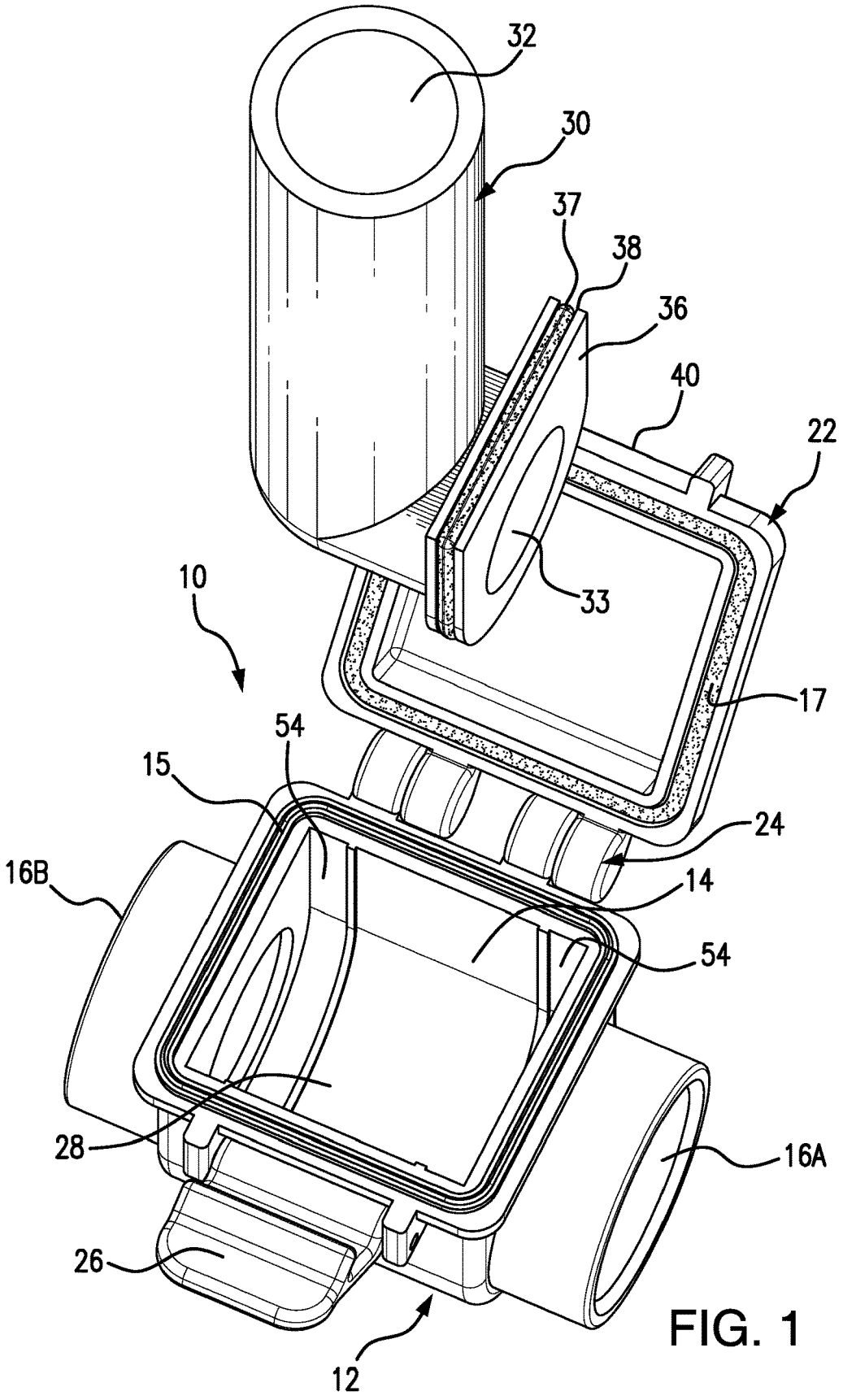
FIG. 1 is an exploded top perspective view of the drain line access device of the present invention shown with the top cover open and a cleanout adapter positioned above the open top of the main body of the access device.
Figure 2:
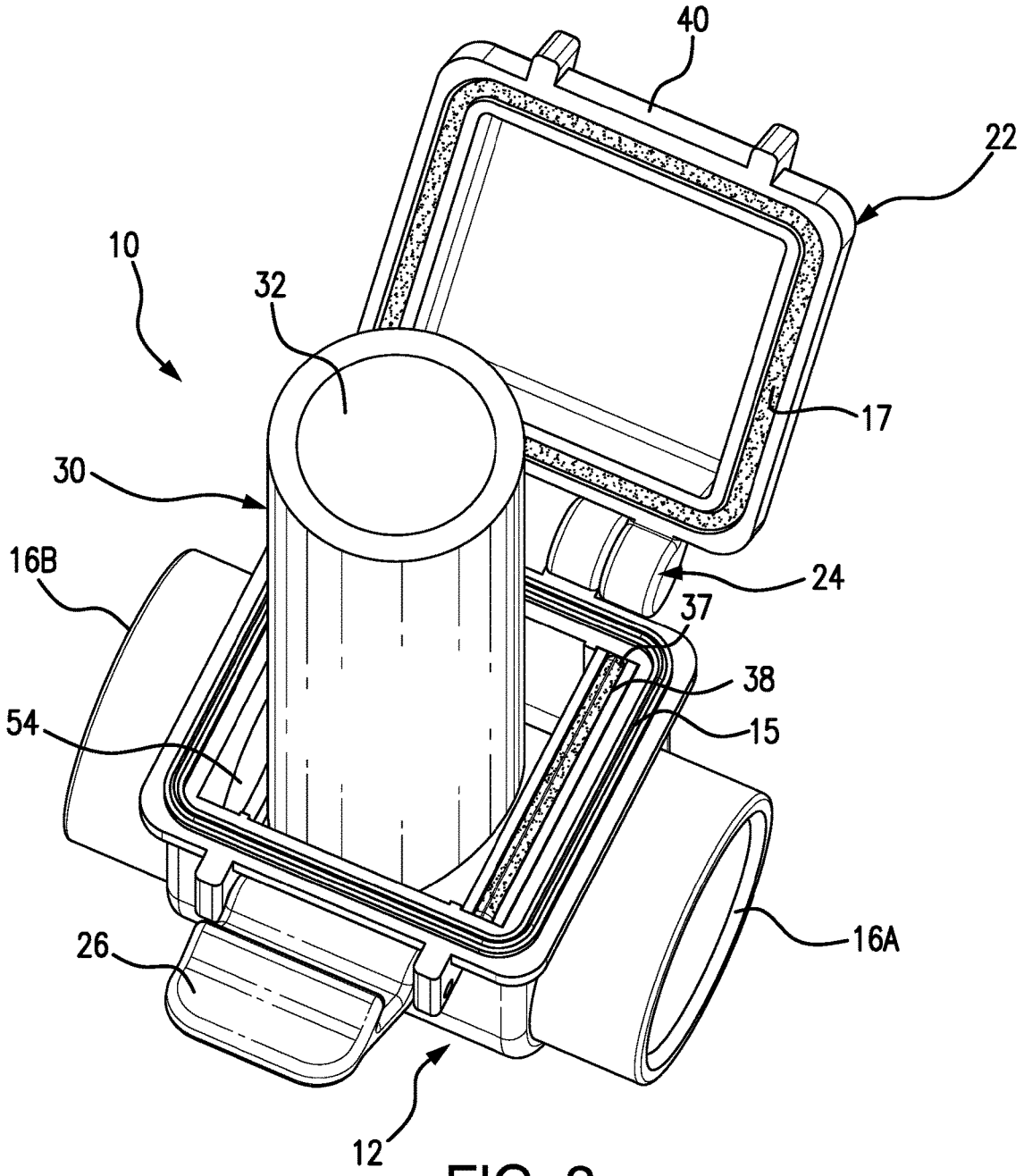
FIG. 2 is a top perspective view of the drain line access device of the present invention shown with the top cover open and the cleanout adapter fitted within an interior cavity of the main body of the access device in operable position for clearing out a drain line connected to the access device.
Figure 3:
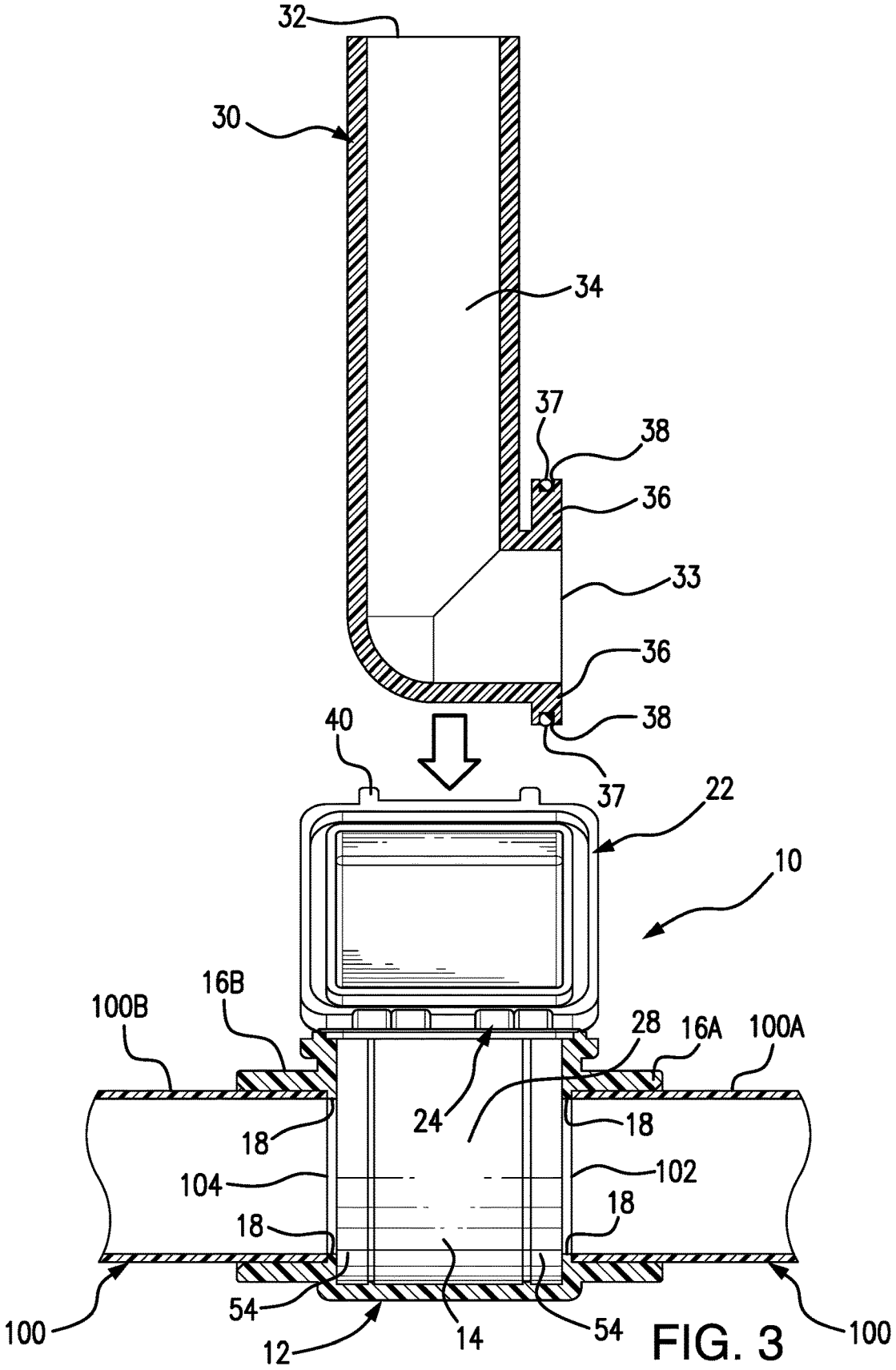
FIG. 3 is a front elevational view, shown in cross section showing the cleanout adapter positioned above the access device with the top cover open and being ready for insertion into the interior cavity of the main body of the access device for alignment with one of the connecting ports of the access device and a drain line connected thereto.

As seen in FIGS. 1-3, the access device 10 includes a main body 12 surrounding an interior chamber 14. The main body 12 has an input connector port 16A and an outlet connector port 16B. The input and outlet connector ports 16A and 16B are positioned on opposite ends of the main body and are each sized and configured for engaged receipt of opposing ends 102, 104 of drain line extensions 100A and 100B of a drain line system 100, thereby allowing for inline installation of the access device 10 to the drain line system. In one embodiment, input port 16A attaches to a drain line extension 100A extending from a condensation producing source (e.g., an air handler unit of an HVAC system) and outlet port 16B is sized and configured for engaged receipt of a drain line extension 100B leading to a drain discharge. An annular shoulder 18 formed within each of the connector ports 16A and 16B serves as a stop member to limit inward movement of the respective ends 102, 104 of the drain line extensions 100A and 100B into the connector ports 16A and 16B so that the ends 102, 104 do not enter into the interior chamber 14 of the access device 10. The top of the main body is open and is surrounded by a rim 15. In a preferred embodiment, the top rim 15 is structured for sealed engagement with a gasket 17 that is fitted within a groove in the underside of a top cover 22 that normally covers and closes the open top of the main body. In a preferred embodiment, the top cover 22 is hingedly secured to one end of the main body 12 by a double pin separating hinge assembly 24. The top cover 22 is releasably secured to the main body 12 by a latch mechanism 26 on the side opposite to the hinge assembly 24. When secured to the main body 12, the top cover 22 covers and seals the open top of the main body 12 closed to define an inner channel 28 between input and outlet connector ports 16A and 16B.

The top cover 22 is easily opened and/or removable from the main body 12 at the double pin separating hinge assembly 24. The latch 26 on the opposite side of the main body hinges upwardly into engagement with fastening member 40 on the top cover 22 for holding the top cover 22 tightly closed against the top rim of the main body in covering and sealed relation to the open top. To open or remove the top cover, the latch 26 is hingedly rotated away from the top cover 22 so that the latch separates from the fastening member 40. The top cover 22 can then be opened (and completely removed if desired) to gain access to the interior chamber 14 of the main body 12 as seen in FIGS. 1-4.

Figure 4:
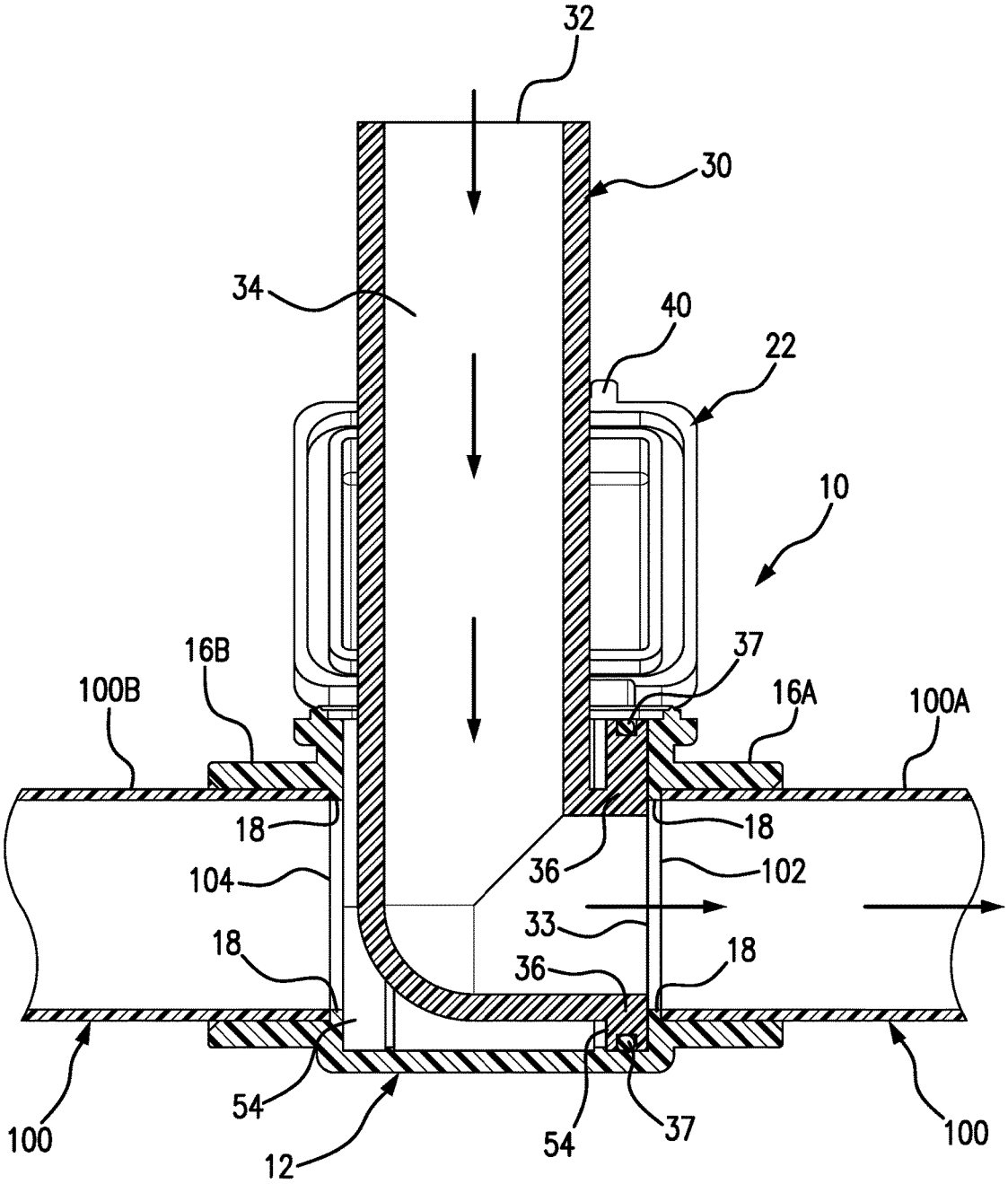
FIG. 4 is a front elevational view, shown in cross section showing the cleanout adapter fitted within a transverse slot adjacent to one of the connecting ports within the interior cavity of the access device showing the bottom opening of the cleanout adapter aligned with the connecting port and attached drain line of the drainage system and indicated a forced flow of liquid or gas, as indicated by the arrows, that is directed through the top opening of the cleanout adapter and into the drain line for clearing a clog therein.
Figure 5:
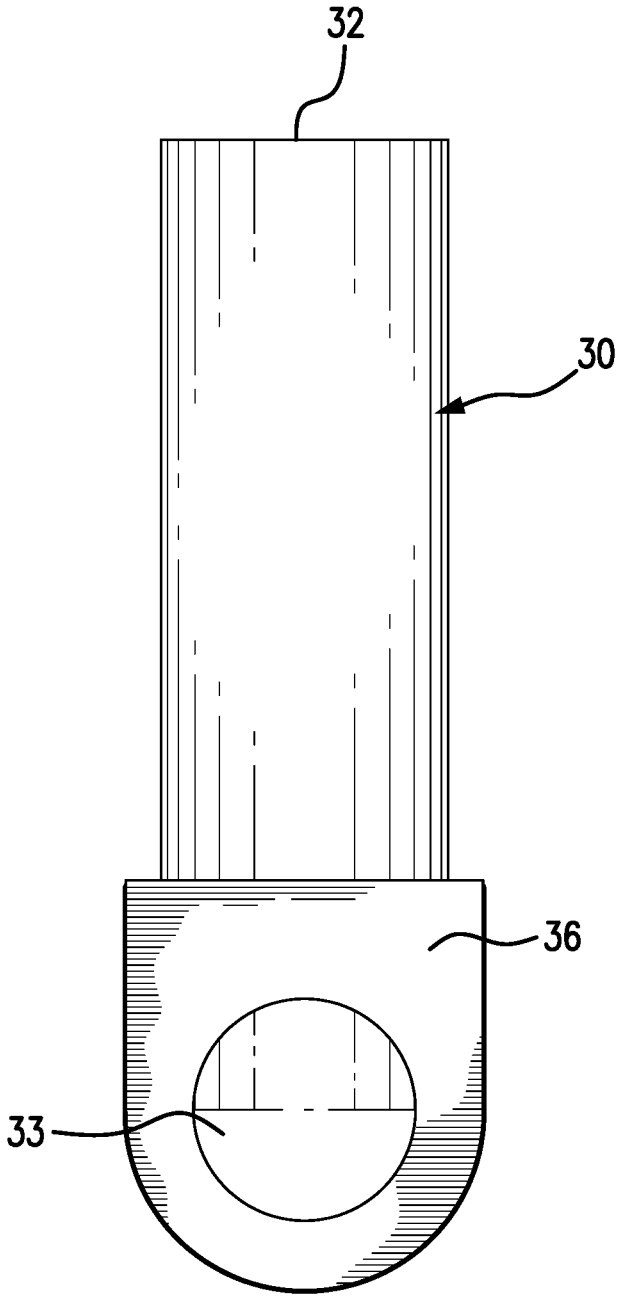
FIG. 5 is a front elevational view of the cleanout adapter of the present invention showing a flange surrounding the bottom opening.

Referring to FIGS. 1 and 3, a cleanout adapter 30 is removably received within either of two transverse slots 54 located at opposite ends of the interior chamber of the main body adjacent to the respective input and outlet connector ports 16A and 16B. The cleanout adapter 30 includes a top opening 32, a bottom opening 33 and a fluid flow passage 34 between the top and bottom openings. As seen throughout the drawings, the cleanout adapter 30 has a generally L-shaped configuration so that the bottom opening 33 is oriented approximately 90 degrees relative to the top opening 32. A flange 36 surrounds the bottom opening 33 and includes a rubber seal 37 fitted within a groove 38 about the periphery of the flange 36. The flange 36 is structured for sliding receipt within either of the two transverse slots 54 at opposite ends of the interior chamber 14. When fully inserted within either of the transverse slots 54, the rubber seal 37 of the flange 36 engages the inside surfaces of the interior chamber 14, within the transverse slot 54, and the bottom opening 33 of the cleanout adapter 30 aligns perfectly with the respective input or outlet port in sealed, fluid flow relation therewith. The cleanout adapter 30 allows for connection of virtually any pressurized gas or liquid flow source, or a vacuum source, as well as pouring of a liquid (e.g., anti-clogging agent) either upstream or downstream in the drain line for flushing out and/or preventing a clog in the drain line. Referring to FIGS. 2 and 4, the generally L-shaped (i.e., 90 degree angle) cleanout adaptor 60 is shown installed within the transverse slot 54 adjacent the inlet connector port 16A. When fully inserted within one of the transverse slots 54, the bottom opening 33 of the cleanout adapter aligns perfectly with the connector port (either 16A or 16B) as well as the attached drain line extension (100A or 100B), and the adapter 30 is held in place without the need of the user to hold onto the adapter 30 during the drain line clearing operation.

While the present invention has been shown and described in accordance with several preferred and practical embodiments, it is recognized that departures from the instant disclosure are contemplated within the spirit and scope of the present invention which are not to be limited except as defined in the following claims, as interpreted under the Doctrine of Equivalents.

What is claimed is:

1. An access device for inline installation to a drain line of a condensation producing source, said device comprising:

a main body having an open top communicating with an interior chamber, and said main body including at least one connecting port sized and configured for sealed connection with the drain line;

a top cover releasably securable to said main body to completely cover the open top of the main body, and the top cover being at least partially releasable from the open top for accessing the interior cavity of said main body;

a slot formed within the interior chamber and adjacent to the at least one connecting port; and a cleanout adapter including a top opening, a bottom opening and a fluid flow passage between the top and bottom openings, and the cleanout adapter further including a flange surrounding the bottom opening, and the flange being structured and disposed for sliding receipt within the slot within the interior cavity for allowing insertion of the cleanout adapter within the interior chamber and alignment of the bottom opening of the cleanout adapter with the at least one connecting port and the drain line, and wherein the top opening of the cleanout adapter is structured for connected attachment with a pressurized flow source or vacuum source to direct a pressurized flow or vacuum force within the drain line with the cleanout adapter inserted within the interior chamber and the bottom opening aligned with the at least one connecting port and drain line.

2. The access device as recited in claim 1 wherein the cleanout adapter further includes a seal fitted about a periphery of the flange for sealed engagement with a surface of the interior chamber within the slot.

3. The access device as recited in claim 2 wherein said main body includes an input connecting port sized and configured for sealed connection with a first segment of the drain line extending between the condensation producing source and said device and an outlet connecting port sized and configured for sealed connection with a second segment of the drain line extending between said device and a drain discharge.

4. The access device as recited in claim 3 wherein the cleanout adapter has a generally L-shaped configuration so that the bottom opening is oriented approximately 90 degrees relative to the top opening.

5. The access device as recited in claim 4 wherein the interior chamber of the main body includes a first slot formed therein and adjacent to the input connecting port and a second slot formed therein and adjacent to the outlet connecting port, wherein the cleanout adapter can be inserted within the slot formed within the interior chamber with the flange slidingly received within either the first slot or the second slot for selectively positioning and aligning the bottom opening of the cleanout adapter with either the input connecting port or the outlet connecting port.

6. An access device for inline installation to a drain line of a condensation producing source, said device comprising:

a main body having an open top communicating with an interior chamber, and said main body including an input connecting port sized and configured for sealed connection with a first segment of the drain line extending between the condensation producing source and said device and an outlet connecting port sized and configured for sealed connection with a second segment of the drain line extending between said device and a drain discharge;

a top cover releasably securable to said main body to completely cover the open top of the main body, and the top cover being at least partially releasable from the open top for accessing the interior cavity of said main body;

a first transverse slot formed within the interior chamber and adjacent to the input connecting port, and a second transverse slot formed within the interior chamber and adjacent to the outlet connecting port; and a cleanout adapter including a top opening, a bottom opening and a fluid flow passage between the top and bottom openings, and the cleanout adapter further including a flange surrounding the bottom opening, and the flange being structured and disposed for sliding receipt within either of the first or second transverse slots within the interior cavity for allowing insertion of the cleanout adapter within the interior chamber and selective alignment of the bottom opening of the cleanout adapter with one of the input connecting port or outlet connecting port, and wherein the top opening of the cleanout adapter is structured for connected attachment with a pressurized flow source or vacuum source to direct a pressurized flow or vacuum force within the drain line with the cleanout adapter inserted within the interior chamber and the bottom opening aligned with one of the input connecting port or outlet connecting port.

7. The access device as recited in claim 6 wherein the cleanout adapter has a generally L-shaped configuration so that the bottom opening is oriented approximately 90 degrees relative to the top opening.

* * * * *